US010601173B2

(12) United States Patent
Altshuler

(10) Patent No.: US 10,601,173 B2
(45) Date of Patent: Mar. 24, 2020

(54) BAYONET CONNECTOR AND METHODS FOR INCORPORATING BAYONET CONNECTOR

(71) Applicant: Canon U.S.A., Inc., Melville, NY (US)

(72) Inventor: Alexander Altshuler, Cambridge, MA (US)

(73) Assignee: Canon U.S.A., Inc., Melville, NY (US)

( * ) Notice: Subject to any disclaimer, the term of this patent is extended or adjusted under 35 U.S.C. 154(b) by 252 days.

(21) Appl. No.: 15/485,607

(22) Filed: Apr. 12, 2017

(65) Prior Publication Data

US 2017/0294741 A1 Oct. 12, 2017

Related U.S. Application Data

(60) Provisional application No. 62/321,509, filed on Apr. 12, 2016.

(51) Int. Cl.
*H01R 13/625* (2006.01)

(52) U.S. Cl.
CPC ..... *H01R 13/625* (2013.01)

(58) Field of Classification Search
CPC .... H01R 13/625; F16L 37/248; F16L 37/252; F16L 37/24
USPC ..... 285/402, 403, 401
See application file for complete search history.

(56) References Cited

U.S. PATENT DOCUMENTS 2,290,403 A * 7/1942 Wyss ..... F16L 37/248 285/110
2,355,407 A * 8/1944 Wyss ..... F16L 37/248 285/111
2,534,723 A * 12/1950 Meese ..... F16L 37/248 285/110
4,737,119 A 4/1988 Stieler
4,789,352 A 12/1988 Kreinberg et al.
4,909,545 A 3/1990 Hohol
5,704,806 A * 1/1998 Post ..... H01R 13/625 439/335
6,039,594 A * 3/2000 Zuppa ..... H01R 13/625 439/318

(Continued)

FOREIGN PATENT DOCUMENTS

CN 202381891 U 8/2012
GB 2503057 A 12/2013

(Continued)

OTHER PUBLICATIONS

"PowerLock and SnapLock High Current Power Connectors Catalog", vearn; http://www.ittcannon.com/Core/medialibrary/ITTCannon/website/Literature/Catalogs-Brochures/ITT-VEAM-PowerLock-and-SnapLock-Catalog-112014-FINAL-ToC2-V5.pdf?ext=.pdf.

(Continued)

*Primary Examiner* — David Bochna
(74) *Attorney, Agent, or Firm* — Canon U.S.A., Inc. IP Division

(57) ABSTRACT

A bayonet style connector and methods for using the connector are provided. The bayonet style connector is particularly capable of single-handed manipulation by a user. It comprises a cylindrical housing; a boss and a locking boss on the outer surface of the cylindrical housing; and a handle. The locking boss is configured to resiliently move relative to the cylindrical housing, and the handle is configured to move the locking boss.

9 Claims, 3 Drawing Sheets

(56) References Cited

U.S. PATENT DOCUMENTS

| | | | | |
|---|---|---|---|---|
| 6,108,865 | A * | 8/2000 | Veser | A47L 9/242 15/344 |
| 6,206,433 | B1 * | 3/2001 | Bloomer | F16L 37/248 285/82 |
| 6,226,068 | B1 | 5/2001 | Arcykiewicz et al. | |
| 6,297,741 | B1 | 10/2001 | Higgins | |
| 6,749,344 | B2 | 6/2004 | Hamm et al. | |
| 6,920,275 | B2 | 7/2005 | Chamorro et al. | |
| 7,726,999 | B2 | 6/2010 | Vanzo | |
| 7,731,243 | B2 | 6/2010 | Tiberghien et al. | |
| 7,805,795 | B2 | 10/2010 | Stein et al. | |
| 8,235,745 | B1 | 8/2012 | Armstrong et al. | |
| 8,899,550 | B2 | 12/2014 | Tiberghien et al. | |
| 9,027,969 | B2 | 5/2015 | Lin | |
| 2004/0035171 | A1 | 2/2004 | Gormany | |
| 2008/0304247 | A1 | 12/2008 | Hsu et al. | |
| 2011/0148107 | A1 * | 6/2011 | Blivet | F16L 37/248 285/402 |
| 2012/0256411 | A1 * | 10/2012 | Chien | F16L 37/252 285/189 |
| 2013/0009396 | A1 | 1/2013 | Larsson et al. | |
| 2014/0042195 | A1 | 2/2014 | Geis et al. | |

FOREIGN PATENT DOCUMENTS

| | | | | |
|---|---|---|---|---|
| WO | WO-0192769 | A2 * | 12/2001 | F16L 37/248 |
| WO | 2011023778 | A1 | 3/2011 | |
| WO | 2014126473 | A1 | 8/2014 | |

OTHER PUBLICATIONS

Type B Vent (Gas); http://www.amerivent.com/typebventgas; accessed Aug. 6, 2015.

* cited by examiner

BAYONET CONNECTOR AND METHODS FOR INCORPORATING BAYONET CONNECTOR

CROSS-REFERENCE TO RELATED APPLICATION(S)

This application claims priority to U.S. Provisional Application Ser. No. 62/321,509 filed 12 Apr. 2016, the content of which is incorporated herein by reference in its entirety.

FIELD OF THE DISCLOSURE

The present disclosure relates generally to a bayonet style connector and methods for using the connector and, more particularly to bayonet style connector capable of single-handed manipulation by a user.

BACKGROUND OF THE DISCLOSURE

Push-in connectors such as Bayonet connectors, RJ-xx electrical connectors, LC and E2000 optical fiber connectors, or connectors for transmitting other types of signals or media, such as gases or liquids, are incorporated in a multitude of industries for use with a wide array of machinery and components.

By way of example, bayonet style connectors are well known and widely used in a range of different applications, and are designed for simple single-handed connection and disconnection. In general, bayonet connectors use an axial spring element to lock the connector in place at the end of a rotational cam motion (See FIG. 6). These type of connectors are functional for single-handed connecting/disconnecting to a large, heavy or anchored receiver. However, when single-handed connecting/disconnecting is attempted on a light and/or unattached receiver, the instability of the receiver in combination with the force exerted by the connecting/disconnecting motion leads to movement of the receiver, thus forcing one to embrace the receiver with a second hand in order to counter the force exerted on the connector. Accordingly, there is a need for an improved bayonet style connector which can be truly manipulated single handedly, regardless of the receivers weight, size and/or stability.

SUMMARY

Accordingly, the present disclosure provides a connecting apparatus and method for using the apparatus, capable of single-handed engagement and disengagement of the connector from a receiver. More specifically, the present connecting apparatus comprises a cylindrical housing having at least one boss configured on the outer surface of the cylindrical housing, as well as having at least one locking boss configured on the outer surface of the cylindrical housing. The apparatus further comprises a handle found on the outer body of the cylindrical housing, wherein the at least one locking boss is configured to resiliently move relative to the cylindrical housing, and wherein the handle in communication with the locking boss is configured to move the locking boss. The locking boss may be configured to resiliently depress into or alongside the cylindrical housing.

In one embodiment of the present disclosure, the locking boss is mounted on a resilient member, configured to resiliently allow the locking boss to depress beneath the outer cylindrical surface of the cylindrical housing.

In another exemplary embodiment, a receiver is provided to receive the connecting apparatus, wherein the receiver includes a cylindrical cavity configured to receive the cylindrical housing, at least one helical cam channel configured to receive the at least one boss, and a chamfer configured to contact the at least one locking boss. In another exemplary embodiment, the receiver also includes a shelf, protruding from the cylindrical cavity, configured to guide the connecting apparatus into the receiver.

In yet another embodiment, the at least one boss protrudes beyond the outer cylindrical surface of the cylindrical housing. According to another embodiment, the at least one locking boss protrudes beyond the outer cylindrical surface of the cylindrical housing.

According to yet another exemplary embodiment of the present disclosure, the handle affecting the locking boss is in indirect communication with the locking boss through the resilient hinge.

These and other objects, features, and advantages of the present disclosure will become apparent upon reading the following detailed description of exemplary embodiments of the present disclosure, when taken in conjunction with the appended drawings, and provided paragraphs.

BRIEF DESCRIPTION OF THE DRAWINGS

Further objects, features and advantages of the present invention will become apparent from the following detailed description when taken in conjunction with the accompanying figures showing illustrative embodiments of the present invention.

Figure 1:
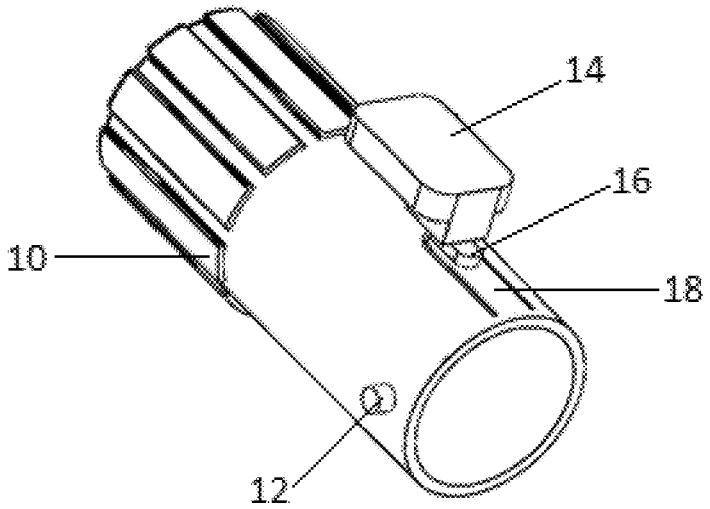
FIG. 1 depicts a front perspective view of the subject connector, in accordance with one or more embodiments of the subject disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure as defined by the appended paragraphs.

DETAILED DESCRIPTION OF THE DISCLOSURE

FIG. 1 depicts a front perspective view of the subject connector 10, in accordance with one or more embodiments of the subject disclosure. The subject connector 10, is cylindrical in shape and incorporates the typical axial rotation of the connector 10 for engagement and disengagement with a receiver 30 (see FIG. 2). The connector 10 uses a boss 12 found on the outer body of the connector 10 to align the connector 10 with the receiver. The boss 12 is sized to slidably fit into the channel 36 of the receiver 30, which is further detailed in FIG. 3. FIG. 1 further details a locking boss 16, which is situated on a resilient hinge 18, which allows the locking boss 16 to be depressed below the outer cylindrical surface of the connector 10. The resilient nature of the hinge 18, allows the locking boss 16 a resistive force, which allows the locking boss 16 to return to its original position (protruding beyond the outer cylindrical surface of the connector 10). A release handle 14 is mounted on the exterior surface of the connector 10, and is in communication with the hinge 18 and/or locking boss 16, such that transposing the release handle 14, transposes the locking boss 16 relative to the connector 10 housing. In one embodiment, the locking boss 16 may be configured to transpose transverse to the cylindrical housing of the connector 10, allowing the boss to resiliently move relative to the housing of the connector 10. In another embodiment, the locking boss 16 is configured to transpose sagittal to the cylindrical housing of the connector 10, or more clearly, the locking boss 16 may be transposed fore and aft, with respect to the outer housing of the connector 10, allowing the boss to engage and retract. In another embodiment, the locking boss 16 is configured to transpose radially about the cylindrical housing of the connector 10, with respect to the outer housing of the connector 10, allowing the boss to engage and retract. In this embodiment, a spring 44 may be implemented to retain the locking boss 16 in the engaged or retracted position (See FIG. 5). In yet another embodiment, the locking boss 16 is configured to transpose axially about the cylindrical housing of the connector 10.

Figure 2:
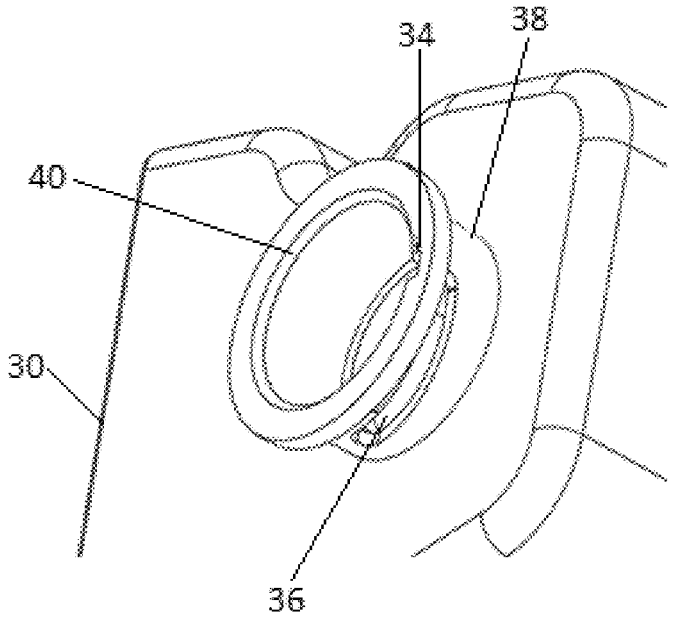
FIG. 2 provides a side perspective view of the receiver which is accepting of the subject connector, in accordance with one or more embodiments of the subject disclosure.

FIG. 2 provides a side perspective view of the receiver 30 which is accepting of the subject connector 10, in accordance with one or more embodiments of the subject disclosure. The receiver 30 is typical of most bayonet-type receivers in the aft, and includes a cylindrical cavity 38 for accepting the connector 10. The inside diameter of the cavity 38 of the receiver 30 is configured to be slightly larger than the outside diameter of the connector 10, to ensure ease of slideable manipulation of the connector 10 in the cavity 38. The receiver 30 further incorporates a channel 36 (not shown) for alignment with the boss 12 found of the connector 10. The channel 36 has an axially aligned lead-in portion 34, which accepts the boss 12 upon initiation of the connector 10 with the receiver 30, and a generally helical cam portion 36. In contrast with a standard bayonet connector, there is no locking portion at the end of the cam portion of the channel. Upon insertion the connector 10 into the receiver 30 and proper orientation of the boss 12 with the lead-in portion 34, the connector 10 will rotate into the receiver 30, wherein the boss 12 is led by the helical cam portion 36, until the boss 12 nears or reaches the end of the channel 36. Upon nearing the end of the channel 36, a locking boss 16, sized to fit into the lead-in portion 34, engages the lead-in portion 34 of the channel 36, thus confining the connector 10 within the receiver 30.

Once engaged, an end user may disconnect the connector 10 from the receiver 30, using a single hand, by depressing the release handle 14, which is rigidly connected to the hinge 18 and/or locking boss 16. Upon depressing the locking boss 16 beneath the outer cylindrical surface of the connector 10, the locking boss 16 is disengaged from the channel 36, and the connector 10 may be rotated along the channel 36, thus disengaging the connector 10 from the receiver 30, using one hand.

Figure 3:
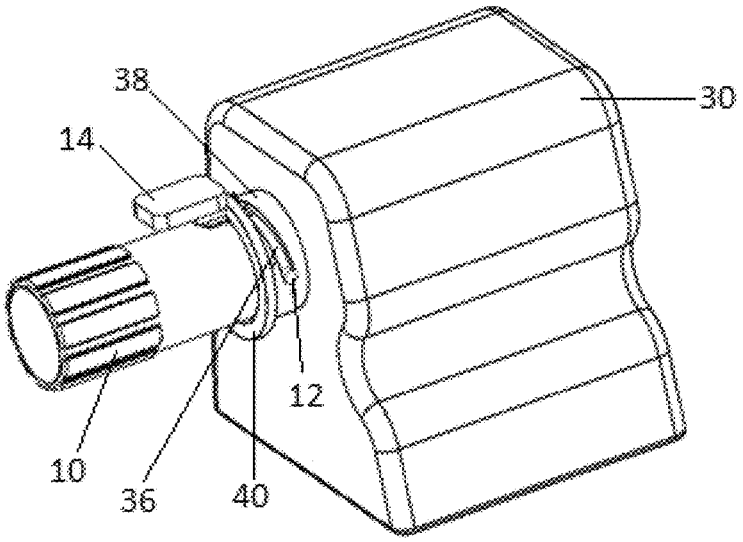
FIG. 3 provides a top perspective view of the subject connector removably affixed to the receiver, in accordance with one or more embodiments of the subject disclosure.

FIG. 3 provides a top perspective view of the subject connector 10 removably affixed to the receiver 30, in accordance with one or more embodiments of the subject disclosure. More specifically, FIG. 3 shows the connector 10 fully engaged with the receiver 30, which is exhibited by the boss 12 being situated near, or at, the end of the channel 36, and the locking boss 16 being engaged with the lead-in portion 34 of the channel 36.

As stated earlier, the connector 10 is inserted axially into the receiver 30 with the boss 12 entering the lead-in portion 34 of the channel 36. When the boss 12 reaches the end of the lead-in portion 34, the boss 12 starts climbing the helical cam portion 36, where upon adequate rotation, the locking boss 16 comes into contact with a chamfer 40 found on the receiver 30 cavity 38. Subsequent rotation of the connector 10 with the boss 12 climbing along the cam portion 36 of the channel 36 creates axial force that allows the locking boss 16 to be depressed by the chamfer 40 inside the cylindrical cavity 38. Near the very end of the connector's 10 rotation along the channel 36, the locking boss 16 reaches the lead-in portion 34 of the channel 36 and, urged by the resilient hinge 18, locks the connector 10 into the receiver 30 using the boss 12, and locking boss 16, and prevents the connector 10 from disconnecting.

It is of importance to note and appreciated that in the present disclosure, connecting or disconnecting the connector 10 from the receiver 3o does not require or impart any axial or lateral force on the connector 10 or receiver 30. This is in part due to the fact that a spring (used to keep the two parts of a typical bayonet connector locked together) is not required in the present disclosure. As a rotational force is the only exertion relayed to the receiver 30 by way of manipulating the connector 10, the receiver only need to be present on a flat stationary surface to allow for single-handed manipulation of the connector 10.

Figure 4:
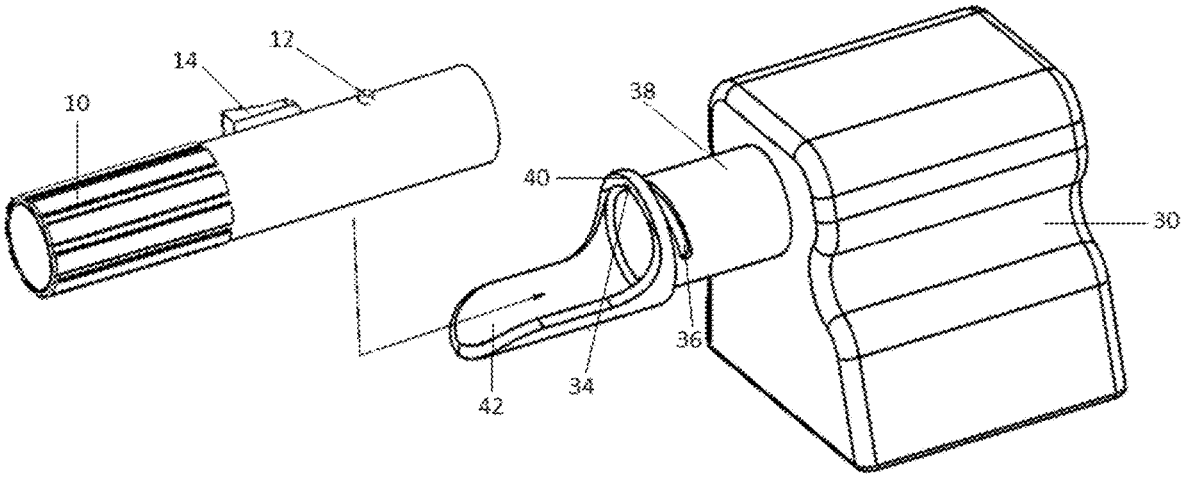
FIG. 4 provides a top perspective view of the subject connector and receiver, in accordance with one or more embodiments of the subject disclosure.

FIG. 4 provides a top perspective view of the subject connector and receiver, in accordance with one or more embodiments of the subject disclosure. FIG. 4 provides another embodiment of the connector 10 and receiver 30, wherein the receiver 30 incorporates a shelf 42, partially protruding from the cylindrical cavity 38, to aid in aligning with the connector 10 with the receiver 30.

Figure 5:
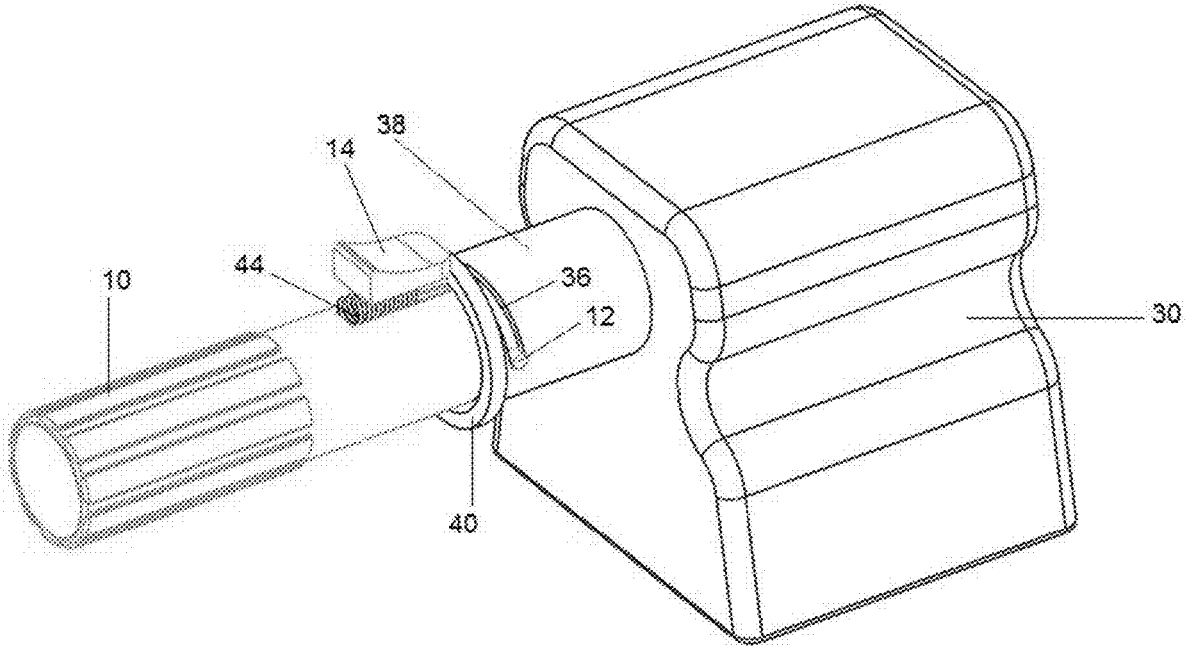
FIG. 5 provides a top perspective view of the subject connector removably affixed to the receiver, in accordance with one or more embodiments of the subject disclosure.

FIG. 5 provides a top perspective view of the subject connector 10 removably affixed to the receiver 30, in accordance with one or more embodiments of the subject disclosure. More specifically, FIG. 5 shows the connector 10 fully engaged with the receiver 30, which is exhibited by the boss 12 being situated near, or at, the end of the channel 36, and the locking boss 16 being engaged with the lead-in portion 34 of the channel 36. Furthermore, FIG. 5 depict the use of a spring 44, engaging the release handle 14.

Figure 6:
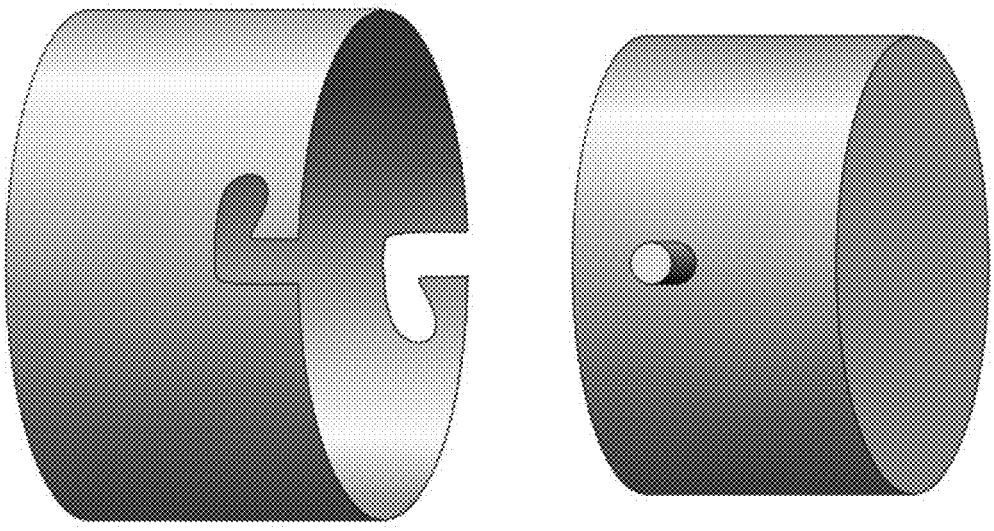
FIG. 6 (prior art)
FIG. 6 provides a side perspective view of an exemplary bayonet type connector in the prior art.

FIG. 6 provides a side perspective view of an exemplary bayonet type connector in the prior art. As mentioned herein, the prior art bayonet connector consisting of a cylindrical male side with one or more radial pins, and a female receptor with matching slot(s) for the pins, wherein one or more spring(s) (not shown) can be found in either the male or female side to keep the two parts locked together. The slots are shaped like a capital letter L with serif (a short upward segment at the end of the horizontal arm); the pin slides into the vertical arm of the L, rotates across the horizontal arm, then is pushed slightly upwards (by the springs) into the short vertical serif. Once attached the connector is no longer free to rotate unless pushed down against the spring until the pin is out of the serif.

The invention claimed is:

1. A connecting apparatus comprising:

a cylindrical housing comprising:

at least one boss configured on the outer surface of the cylindrical housing;

at least one locking boss located on a resilient hinge formed by a slot in the outer surface of the cylindrical housing; and a handle in communication with the locking boss, and a receiver adapted to receive the cylindrical housing, wherein the receiver comprises:

a cylindrical cavity configured to receive the cylindrical housing; and at least one helical cam channel configured to receive the at least one boss, wherein the at least one locking boss is configured to resiliently move relative to the cylindrical housing, wherein the handle in communication with the locking boss is configured to move the locking boss, wherein connecting and disconnecting the cylindrical housing to the receiver requires manipulation of the cylindrical housing only, and wherein the receiver is immobilized and configured to resist a force exerted upon the receiver when connecting and disconnecting the cylindrical housing.

2. The connecting apparatus according to claim 1, wherein the manipulation of the cylindrical housing is in a plane parallel to the helical cam channel.

3. The connecting apparatus according to claim 1, wherein the receiver further comprises a shelf configured to guide the connecting apparatus into the receiver.

4. The connecting apparatus according to claim 1, wherein the at least one boss protrudes beyond the outer cylindrical surface of the cylindrical housing.

5. The connecting apparatus according to claim 1, wherein the at least one locking boss protrudes beyond the outer cylindrical surface of the cylindrical housing.

6. The connecting apparatus according to claim 1, wherein the locking boss is configured to transpose transverse to the cylindrical housing.

7. The connecting apparatus according to claim 1, wherein the locking boss is configured to transpose radially about to the cylindrical housing.

8. The connecting apparatus according to claim 1, wherein the locking boss is configured to transpose axially about the cylindrical housing.

9. The connecting apparatus according to claim 1, further comprising: at least one chamfer found on the receiver and/or locking boss.

* * * * *